US007735553B2

(12) United States Patent
Carlin et al.

(10) Patent No.: US 7,735,553 B2
(45) Date of Patent: Jun. 15, 2010

(54) SNAP-LOCK BUSHING FOR PREPACKED SCREENS

(75) Inventors: Mike B. Carlin, Salina, KS (US); Thomas M. Christy, Salina, KS (US); David W. Cooper, Salina, KS (US); Allen M. Paradis, Salina, KS (US)

(73) Assignee: Kejr Inc., Salina, KS (US)

( * ) Notice: Subject to any disclaimer, the term of this patent is extended or adjusted under 35 U.S.C. 154(b) by 230 days.

(21) Appl. No.: 11/768,886

(22) Filed: Jun. 26, 2007

(65) Prior Publication Data

US 2008/0001403 A1 Jan. 3, 2008

Related U.S. Application Data

(60) Provisional application No. 60/818,097, filed on Jun. 30, 2006.

(51) Int. Cl.
*E21B 43/34* (2006.01)

(52) U.S. Cl. ..... 166/228; 175/314

(58) Field of Classification Search ..... 166/227, 166/228; 285/295.1; 175/314; 403/365
See application file for complete search history.

(56) References Cited

U.S. PATENT DOCUMENTS 5,660,484 A * 8/1997 Peel ..... 384/539

* cited by examiner

*Primary Examiner*—David J Bagnell
*Assistant Examiner*—Catherine Loikith
(74) *Attorney, Agent, or Firm*—Jeffrey L. Thompson; Thompson & Thompson, PA

(57) ABSTRACT

A snap-lock bushing is provided for use with prepacked screens for monitoring wells. The bushing has an inner bore for sliding over a tubular well casing member and a raised lip protruding from the inner bore for engaging corresponding grooves at each end of the well casing member. The raised lip includes a plurality of lip segments with gaps or slots formed between the lip segments, which allow the raised lip to flex outward during assembly. A prepacked screen is assembled using a snap-lock bushing at each end of the well casing member. A mesh screen is placed in a concentric relationship around the well casing member with the ends of the mesh screen secured over the outer cylindrical surfaces of the bushings. A filter pack of granular material is placed in the concentric space between the well casing member and the screen member during assembly.

11 Claims, 4 Drawing Sheets

SNAP-LOCK BUSHING FOR PREPACKED SCREENS

RELATED APPLICATIONS

This application claims priority of U.S. Provisional Application No. 60/818,097 filed on Jun. 30, 2006. The content of this prior application is incorporated herein by reference.

BACKGROUND OF THE INVENTION

1. Field of the Invention

The present invention relates generally to devices for installing wells. In particular, the present invention relates to devices for assembling and installing groundwater-monitoring wells and other wells having prepacked screens.

2. Description of the Related Art

Conventional groundwater monitoring wells are typically constructed through hollow stem augers or probe rods by lowering slotted PVC pipe (screen) to depth on the leading end of a string of threaded PVC riser pipe. A filter pack is then installed by pouring clean sand or other granular material of known particle size through the tool string annulus until the slotted section of the PVC pipe is sufficiently covered.

Installing the entire filter pack through the tool string annulus becomes a delicate and time-consuming process when performed with small-diameter, direct push tooling. Granular material must be poured very slowly to avoid bridging between the riser pipe and surrounding probe rod. When bridging does occur, considerable time can be lost in attempting to dislodge the granular material or possibly pulling the tool string and starting over.

Prepacked screens have been developed to improve the monitoring well installation process. An example of a conventional prepacked screen assembly 50 is shown in FIGS. 1 to 4 of the accompanying drawings. As shown in FIG. 1, a conventional monitoring well with a prepacked screen assembly 50 can be installed using direct push tooling having an expendable point 60 at the lower end, a PVC plug 61 at the bottom of the screen assembly 50, a PVC riser 62 above the screen assembly 50, and a locking plug 63 with a padlock 64 at the upper end of the PVC riser 62. After placement in the soil bore, the prepacked screen assembly 50 is covered by a grout barrier 65, a Bentonite well seal 66 above the grout barrier 65, and a neat cement grout barrier 67 above the Bentonite well seal 66. A concrete pad 68 and a flush mount well cover 69 are placed over the well at the soil surface 70 to complete the installation.

The prepacked screen assembly 50 in the conventional monitoring well typically includes a standard, slotted PVC well casing 51 surrounded by a stainless steel mesh 52. Granular material S is packed between the slotted PVC well casing 51 and the stainless steel mesh 52 by the manufacturer before the product is delivered to the consumer. Since the granular material S is packed around the slotted PVC well casing 51 before it is installed, the use of prepacked screen assemblies 50 guarantees that granular material S will be located directly around the well casing 51, and that the slotted PVC well casing 51 will be concentrically located in the granular material S. This makes well installation quicker and more efficient than conventional methods. It has been shown that the quality of samples obtained from wells installed with prepacked screen assemblies 50 correlates well with samples obtained from conventionally installed wells, but at less cost.

Prepacked screen assemblies 50 greatly decrease the amount of time, cuttings and loose sand or other granular material required for well installation as each screen assembly includes the necessary filter pack. Granular material must still be delivered through the casing annulus to provide a minimum 2-foot grout barrier, but this volume is significantly less than for the entire screened interval.

A common method for building prepacked screen assemblies 50 involves using a smooth-bored PVC bushing 53, held axially in place on the slotted pipe 51 by a stainless steel clamp 54, as shown in FIGS. 3 and 4. Although quite common, this method has limitations, most notably with respect to the time to assemble, as well as the permanence of the fastening. Considerable time is spent in assuring that the bushing 53 is correctly located along the length of the slotted pipe 51. The bushing 53 is then secured by placing and crimping the stainless steel clamp 54 on the slotted pipe 51 behind the bushing 53 to act as a shoulder, preventing it from moving axially in one direction. The stainless steel band 54 does not prevent the bushing 53 from moving in the other direction, nor is the bushing 53 fastened so securely that it cannot be made to slide out of position. The stainless steel mesh 52 is secured at each of its ends to the outer surfaces of the respective bushings 53 using stainless steel clamps 55.

Thus, there is a need in the industry for an improved device for assembling prepacked screens for monitoring wells.

SUMMARY OF THE INVENTION

An object of the present invention is to provide a device to facilitate assembling a prepacked screen for a monitoring well.

More specifically, an object of the present invention is to provide a device that can be easily and quickly secured at a correct location along a well casing member to support a mesh screen material in a concentric relationship around the well casing member for containing a filter pack of granular material about the well casing member.

In order to accomplish these and other objects of the invention, a snap-lock bushing is provided for use with prepacked screens for monitoring wells. The bushing has an inner bore for sliding over a tubular well casing member and a raised lip protruding from the inner bore for engaging corresponding grooves at each end of the well casing member. The raised lip includes a plurality of lip segments with gaps or slots formed between the lip segments, which allow the raised lip to flex outward during assembly. A prepacked screen is assembled using a snap-lock bushing at each end of the well casing member. A mesh screen is placed in a concentric relationship around the well casing member with the ends of the mesh screen secured over the outer cylindrical surfaces of the bushings. A filter pack of granular material is placed in the concentric space between the well casing member and the screen member during assembly.

According to one broad aspect of the invention, a prepacked screen assembly is provided, comprising: a tubular well casing member having an outer cylindrical surface with a first groove formed therein; and a first bushing having an inner bore with a raised lip for engaging the first groove to prevent axial movement of the first bushing. The raised lip is flexible in a radially outward direction during assembly to permit the first bushing to slide over the tubular well casing member until the raised lip engages the first groove.

According to another broad aspect of the invention, a snap-lock bushing for prepacked well screens is provided, comprising: an inner portion having an inner bore for sliding over a tubular well casing member and a raised lip protruding from the inner bore for engaging a corresponding groove in the well casing member; an outer portion having an outer cylindrical surface for positioning a mesh screen material in a concentric relationship around the well casing member; and an intermediate portion connecting the inner and outer portions to form a single integral unit.

Numerous other objects of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the present invention is made with reference to the accompanying drawings. In the drawings.

DETAILED DESCRIPTION OF THE INVENTION

Figure 5:
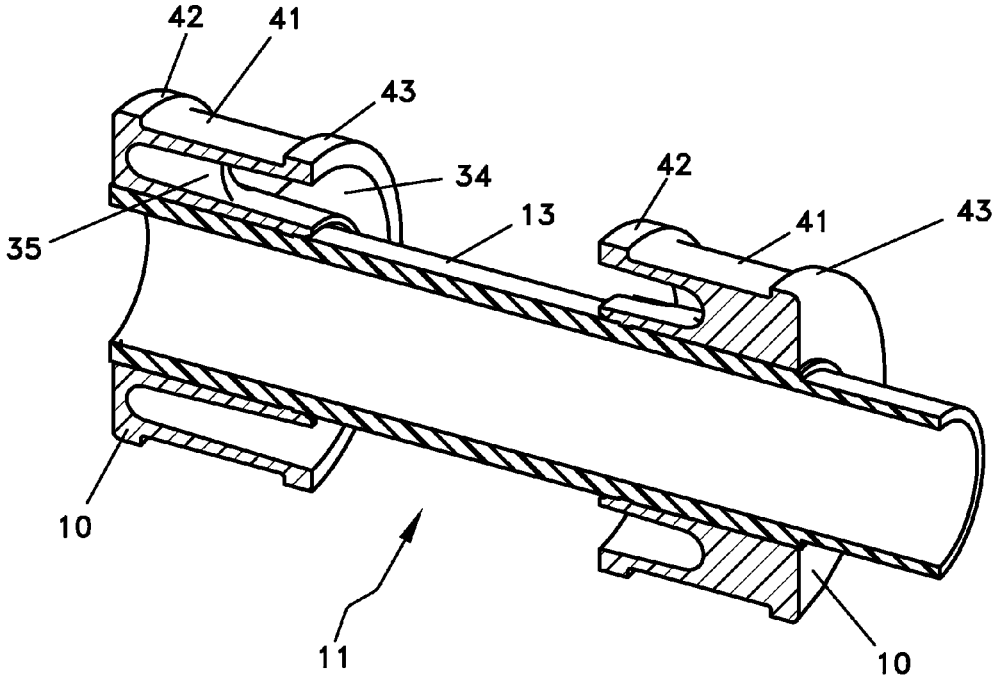
FIG. 5 is a cross-sectional perspective view of a prepacked screen assembly with snap lock bushings according to an embodiment of the present invention.
Figure 6:
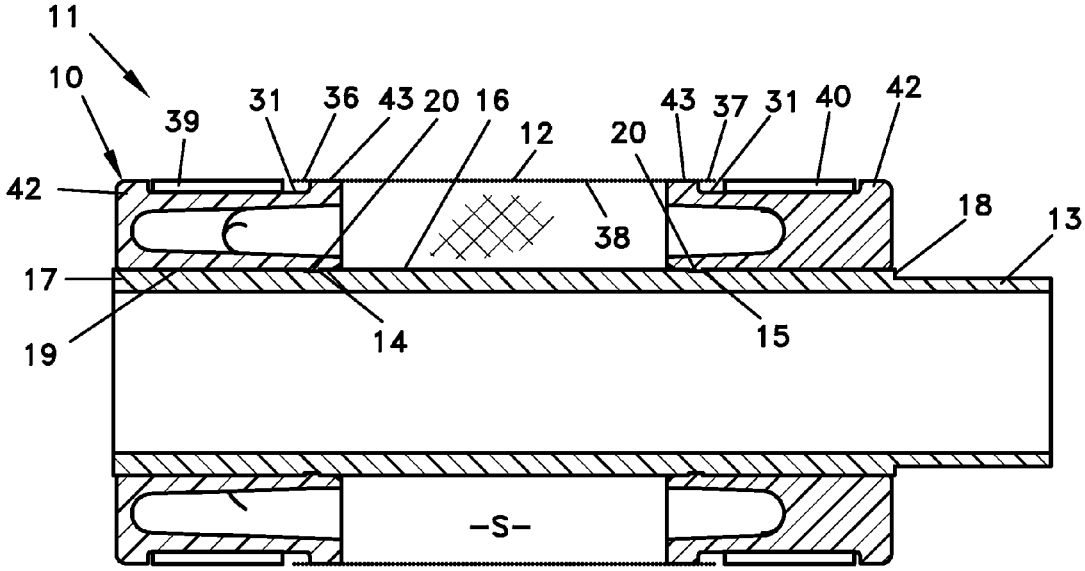
FIG. 6 is a cross-sectional side view of the prepacked screen assembly shown in FIG. 5.
Figure 7:
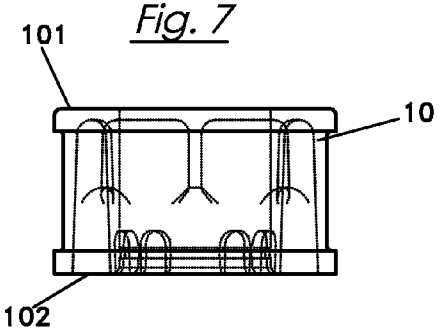
FIG. 7 is an elevation view of a snap lock bushing used with the prepacked screen assembly according to the present invention.
Figure 10:
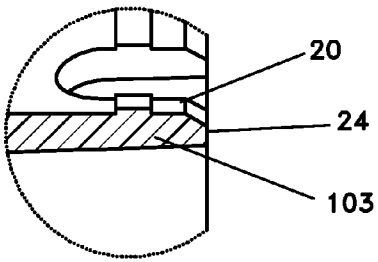
FIG. 10 is a detail view of a portion of the snap lock bushing as indicated in FIG. 9.
Figure 9:
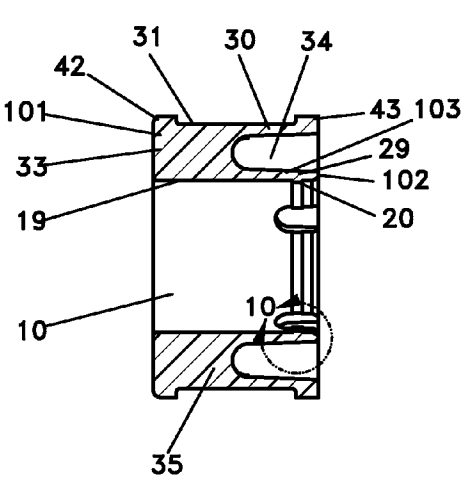
FIG. 9 is a cross section view of the snap lock bushing taken along line 9-9 in FIG. 8.
Figure 8:
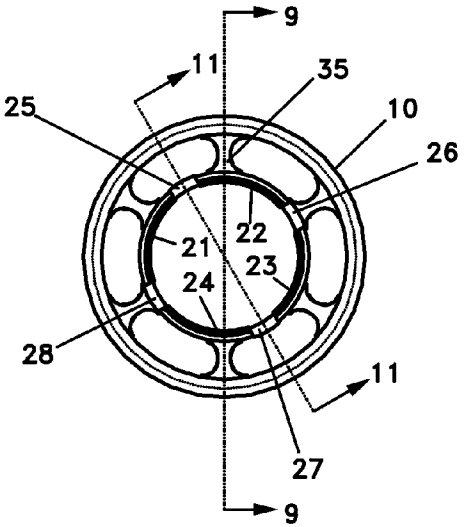
FIG. 8 is a bottom view of the snap lock bushing shown in FIG. 7.
Figure 11:
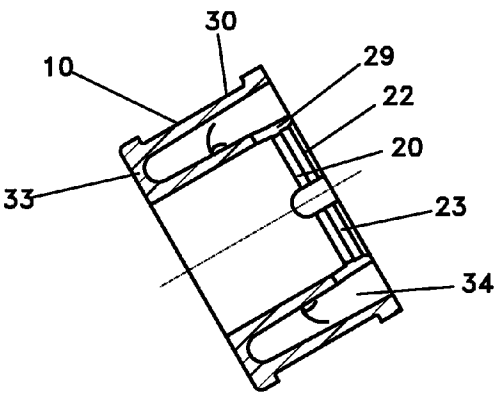
FIG. 11 is a cross section view of the snap lock bushing taken along line 11-11 in FIG. 8.

A snap-lock bushing 10 for use with prepacked screen assemblies 11 according to an embodiment of the present invention will now be described with reference to FIGS. 5 to 11 of the accompanying drawings.

The snap-lock bushing 10 of the present invention is used with prepacked screens 11 for monitoring wells. The bushing 10 functions to concentrically position a mesh screen member 12 around a tubular well casing member 13, and to contain a filter pack of granular material S around the casing member 13. A prepacked screen assembly 11 according to the present invention uses two snap-lock bushings 10, one positioned near each end of the tubular well casing member 13.

Figure 1:
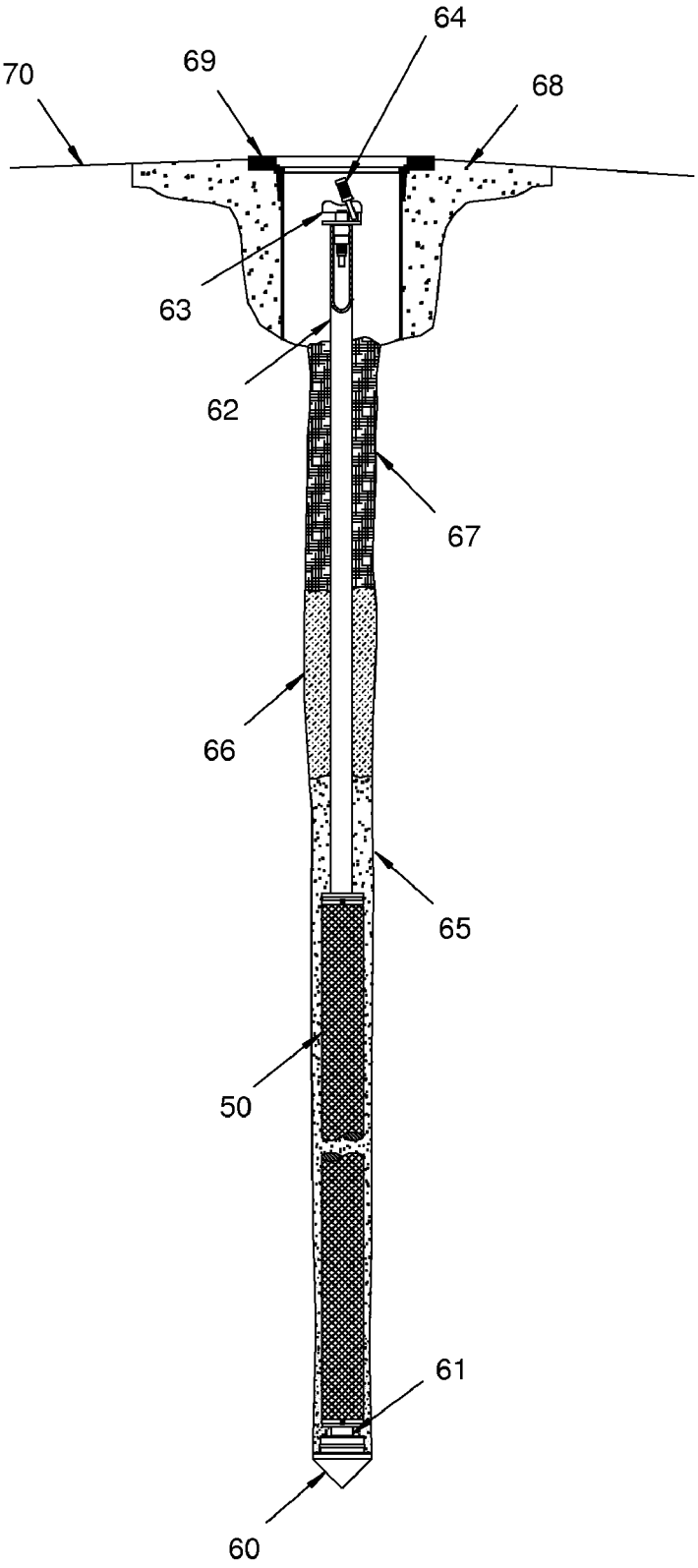
Fig. 1 (Prior Art)
FIG. 1 is an elevation view of a conventional prepacked screen monitoring well.
Figure 2:
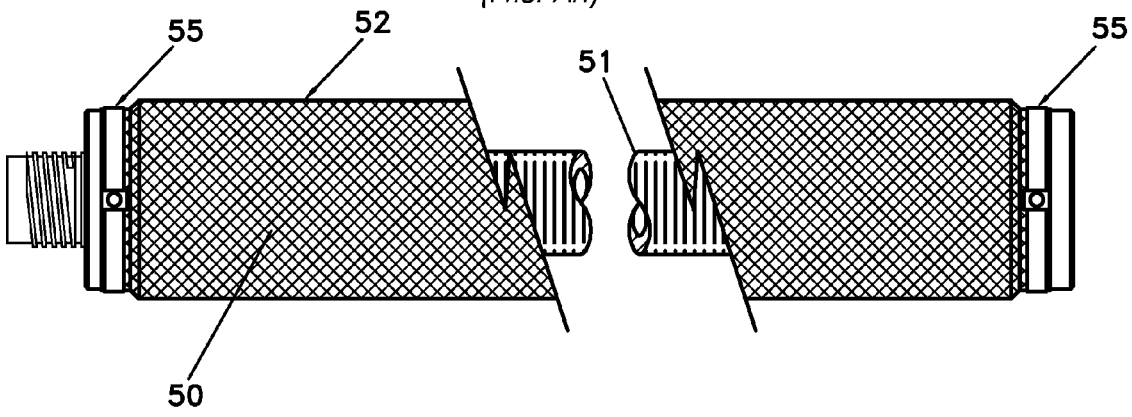
Fig. 2 (Prior Art)
FIG. 2 is a partially cutaway side view of a conventional prepacked screen assembly for a monitoring well.
Figure 3:
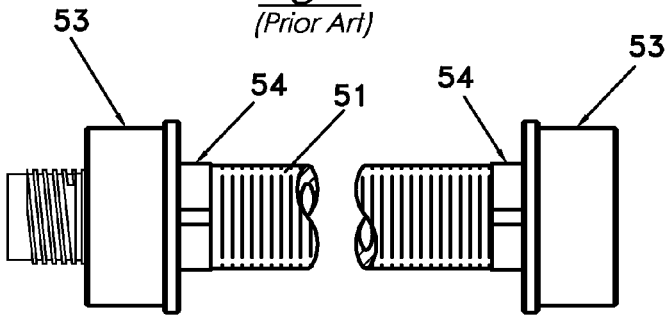
Fig. 3 (Prior Art)
FIG. 3 is a side view of the conventional screen assembly shown in FIG. 2 without the mesh screen.
Figure 4:
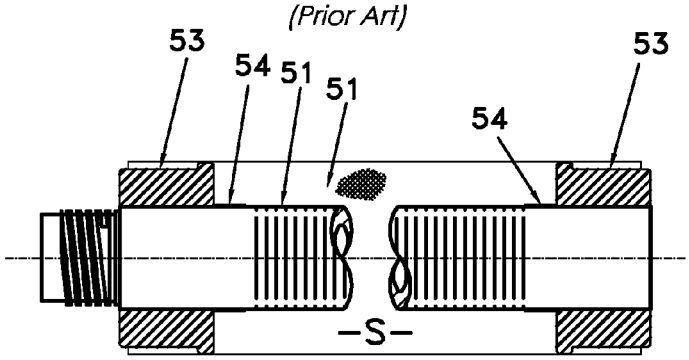
Fig. 4 (Prior Art)
FIG. 4 is a side view of the conventional screen assembly shown in FIG. 2 with the smooth-bored PVC bushings shown in cross section.

The tubular well casing member 13 in the disclosed embodiment is a slotted PVC pipe similar to the slotted pipe used in the conventional prepacked screen assembly shown in FIGS. 1 to 4, except that additional grooves 14, 15 are formed in the outer cylindrical surface 16 of the slotted pipe. The additional grooves 14, 15 include a first groove 14 formed near a first end 17 of the slotted pipe 13, and a second groove 15 formed near a second end 18 of the slotted pipe axially spaced from the first groove 14.

First and second snap-lock bushings 10 are positioned near the respective ends 17, 18 of the well casing member 13. In one embodiment, the snap-lock bushings 10 are formed as molded plastic components using, for example, PVC material. Each snap-lock bushing 10 has an inner bore 19 for sliding over the tubular well casing member 13 and a raised lip 20 protruding from the inner bore 19 for engaging the corresponding grooves 14, 15 at each end of the well casing member 13. The raised lip 20 functions to both position and secure the bushing 10 with respect to the well casing member 13. The inner diameter of the raised lip 20 is smaller than the outer diameter of the well casing member 13.

The raised lip 20 includes a plurality of lip segments 21-24 with gaps or slots 25-28 formed between the lip segments. The gaps or slots 25-28 formed between the lip segments 21-24 allow the raised lip 20 to flex radially outward during assembly to permit the bushing 10 to slide over the tubular well casing member 13 until the raised lip 20 engages the corresponding groove 14, 15 in the well casing member 13. When the raised lip segments 21-24 pass over the corresponding groove 14, 15 in the well casing member 13, the raised lip segments 21-24 flex back toward their original position, engaging the groove 14, 15, and locking the bushing 10 securely in place. The gaps or slots 25-28 also serve as an egress passage for sand or debris that might otherwise prevent the raised lip 20 from engaging the grooves 14, 15.

The snap-lock bushings 10 have an inner portion 29 on which the raised lip 20 is formed, an outer portion 30 on which an outer cylindrical surface 31 is provided for positioning and securing a cylindrical-shaped mesh screen member 12 in a concentric relationship around the well casing member 13, and an intermediate portion 33 connecting the inner and outer portions 29, 30 to form a single integral unit. An open space 34 is provided between the inner and outer portions 29, 30 on one side of the intermediate portion 33 for allowing the raised lip segments 21-24 to flex and for accommodating part of a filter pack of granular material S surrounding the well casing member 13. A plurality of support structures 35 can also be molded into the bushing 10 to strengthen the molded unit while still providing the open space 34 between the inner and outer portions 29, 30.

The bushings 10 each have first and second axial ends 101, 102. The intermediate portion 33 connects the inner and outer portions 29, 30 adjacent the first axial end 101. The raised lip 20 extends radially inward from the inner bore 19 adjacent the second axial end 102. The raised lip segments 21-24 are formed on the inner surfaces of a plurality of axially extending segments 103 that extend in a cantilever fashion along the inner bore 19 toward the second axial end 102.

The cylindrical-shaped mesh screen member 12 is concentrically positioned around the well casing member 13. The mesh screen member 12 has first and second ends 36, 37 secured over the respective outer surfaces 31 of the first and second snap-lock bushings 10. The mesh screen member 12 can be, for example, the same stainless steel mesh used in the conventional prepacked screen assembly shown in FIGS. 1 to 4.

A filter pack of granular material S is placed in the annular space between the well casing member 13 and the mesh screen member 12 during assembly. The filter pack of granular material S surrounds the well casing member 13 and is contained within an area defined by the outer cylindrical surface 16 of the well casing member 13, an inner surface 38 of the mesh screen member 12, and the facing ends of the first and second bushings 10. That is, the ends of the annular space created by the mesh screen member 12 and the well casing member 13 are sealed off by the snap-lock bushings 10.

First and second stainless steel clamps 39, 40 are used to secure the mesh screen member 12 to the outer surfaces 31 of the first and second snap-lock bushings 10, respectively. The outer surfaces 31 of the snap-lock bushings 10 each include a relieved area 41 for accommodating the clamps 39, 40. The relieved area 41 has a reduced diameter as compared to the raised portions 42, 43 at each end of the bushings 10. The raised portion 42 at the leading edge of the outer diameter 31 of each bushing 10 also serves to protect the handler's hands from the sharp edge at the end of the mesh screen member 12.

The assembling process for the prepacked screen assembly 11 using the snap-lock bushings 10 of the present invention will now be described.

A first one of the snap-lock bushings 10 is slid over the outer surface 16 at a first end of the well casing member 13 until it is secured in place by the raised lip 20 engaging the corresponding groove 14, 15 in the well casing member 13. The mesh screen member 12 is then placed around the well casing member 13 with a first end of the mesh screen member 12 over the outer surface 31 of the first snap-lock bushing 10. A first clamp 39 is used to secure the first end of the mesh screen member 12 to the outer surface 31 of the first snap-lock bushing 10. Loose granular material S of a desired particle size is then poured into the annular space between the well casing member 13 and the mesh screen member 12 until the annular space is substantially full with just enough room to still secure the second snap-lock bushing 10 over the second end of the well casing member 13. The second snap-lock bushing 10 is then slid over the outer surface 16 of the second end of the well casing member 13 until it is secured in place by its raised lip 20 engaging the corresponding groove 14, 15 in the well casing member 13. The open space 34 between the inner and outer portions 29, 30 of the snap-lock bushing 10 allows some of the granular material S to be contained within the interior of the snap-lock bushing 10 to accommodate slight variations in the amount of granular material within the annular space. A second end of the mesh screen member 12 is positioned over the outer surface 31 of the second snap-lock bushing 10 and is secured to the outer surface 31 of the second snap-lock bushing 10 by a second clamp 40.

The snap-lock bushings 10 of the present invention provide a substantial improvement over the smooth bore bushings used in the conventional prepacked screen assemblies. The snap-lock bushings 10 can be quickly and easily slid into place, and are positively located and secured by aligning the raised lip 20 with the corresponding groove 14, 15 formed in the well casing member 13. This coupling arrangement offers repeatability and consistency, and makes the assembling process faster and less labor intensive. The snap-lock bushings 10 are also less susceptible to slipping out of position.

Those skilled in the art will recognize that various changes or modifications of the snap-lock bushing 10 and prepacked screen assemblies 11 described herein can be made. For example, the snap-lock bushing 10 can be made larger or smaller so as to be used with larger or smaller prepacked screen assemblies 11. Similarly, the internal diameter and notch size of the snap-lock bushing 10 can be altered to meet the needs of larger or smaller prepacked screen assemblies 11. The materials of construction of the snap-lock bushing 10 can be changed to maintain chemical compatibility or chemical resistance to any chemical pollutants thought to be present at the site to be monitored.

While the invention has been specifically described in connection with specific embodiments thereof, it is to be understood that this is by way of illustration and not of limitation, and the scope of the appended claims should be construed as broadly as the prior art will permit.

What is claimed is:

1. A prepacked screen assembly, comprising:

a tubular well casing member having an outer cylindrical surface with a first groove formed therein;

a first bushing having an inner bore with a raised lip for engaging said first groove to prevent axial movement of said first bushing, said raised lip being flexible in a radially outward direction during assembly to permit the first bushing to slide over the tubular well casing member until the raised lip engages said first groove;

a second groove formed in the outer cylindrical surface of the tubular well casing member at a location axially spaced from said first groove;

a second bushing having an inner bore with a raised lip for engaging said second groove to prevent axial movement of said second bushing, said raised lip of said second bushing being flexible in a radially outward direction during assembly to permit the second bushing to slide over the tubular well casing member until the raised lip engages said second groove;

wherein said first and second bushings each comprises an outer surface, and further comprising a cylindrical-shaped mesh screen member concentrically positioned around said well casing member with a first end of the mesh screen member secured over the outer surface of said first bushing and a second end of the mesh screen member secured over the outer surface of said second bushing, and a filter pack of granular material surrounding the well casing member and contained within an area defined by the outer cylindrical surface of the well casing member, an inner surface of the screen member, and the first and second bushings; and further comprising first and second clamps for securing the mesh screen member to the outer surfaces of the first and second bushing members, respectively.

2. The prepacked screen assembly according to claim 1, wherein the outer surfaces of said first and second bushings are each formed with a relieved area for accommodating said first and second clamps.

3. A prepacked screen assembly, comprising:

a tubular well casing member having an outer cylindrical surface with a first groove formed therein; and a first bushing having an inner bore with a raised lip for engaging said first groove to prevent axial movement of said first bushing, said raised lip being flexible in a radially outward direction during assembly to permit the first bushing to slide over the tubular well casing member until the raised lip engages said first groove;

wherein said first bushing has an inner portion on which said raised lip is formed, an outer portion on which an outer cylindrical surface is provided for securing a mesh screen material, and an open space defined between the inner and outer portions for allowing the raised lip to flex and for accommodating part of a filter pack of granular material surrounding the well casing member.

4. A snap-lock bushing for prepacked well screens, comprising:

an inner portion having an inner bore for sliding over a tubular well casing member and a raised lip protruding from the inner bore for engaging a corresponding groove in the well casing member;

an outer portion having an outer cylindrical surface for positioning a mesh screen material in a concentric relationship around the well casing member; and an intermediate portion connecting said inner and outer portions to form a single integral unit;

wherein an open space is defined between the inner and outer portions for allowing the raised lip to flex outwardly during assembly and for accommodating part of a filter pack of granular material surrounding the well casing member.

5. A snap-lock bushing for prepacked well screens, comprising:

an inner portion having an inner bore for sliding over a tubular well casing member and a raised lip protruding from the inner bore for engaging a corresponding groove in the well casing member;

an outer portion having an outer cylindrical surface for positioning a mesh screen material in a concentric relationship around the well casing member; and an intermediate portion connecting said inner and outer portions to form a single integral unit;

wherein the outer surface is formed with a relieved area for accommodating a clamp for securing a mesh screen to the outer surface of the bushing.

6. A snap-lock bushing for prepacked well screens, comprising:

an inner portion having an inner bore for sliding over a tubular well casing member and a raised lip protruding from the inner bore for engaging a corresponding groove in the well casing member;

an outer portion having an outer cylindrical surface for positioning a mesh screen material in a concentric relationship around the well casing member; and an intermediate portion connecting said inner and outer portions to form a single integral unit;

wherein the bushing has first and second axial ends, said intermediate portion connects the inner and outer portions adjacent said first axial end, and said raised lip extends radially inward from said inner bore adjacent said second axial end, and said raised lip is formed on inner surfaces of a plurality of axially extending segments that extend in a cantilever fashion along the inner bore toward said second axial end;

wherein the outer surface is formed with a relieved area between the first and second axial ends for accommodating a clamp for securing a mesh screen to the outer surface of the bushing.

7. A prepacked screen assembly for a well, comprising:

a tubular well casing member having an outer cylindrical surface with first and second grooves formed in the outer cylindrical surface at locations axially spaced from each other;

a first bushing having an inner bore with a raised lip for engaging said first groove to lock said first bushing at a desired location along said tubular well casing, said raised lip being flexible in a radially outward direction during assembly to permit the first bushing to slide over the tubular well casing member until the raised lip engages said first groove, said first bushing further comprising an outer surface;

a second bushing having an inner bore with a raised lip for engaging said second groove to lock said second bushing at a desired location along said tubular well casing, said raised lip of said second bushing being flexible in a radially outward direction during assembly to permit the second bushing to slide over the tubular well casing member until the raised lip engages said second groove, said first bushing further comprising an outer surface;

a cylindrical-shaped mesh screen member concentrically positioned around said well casing member with a first end of the mesh screen member secured over the outer surface of said first bushing and a second end of the mesh screen member secured over the outer surface of said second bushing; and a filter pack of granular material surrounding the well casing member and contained within an area defined by the outer cylindrical surface of the well casing member, an inner surface of the screen member, and the first and second bushings.

8. The prepacked screen assembly according to claim 7, further comprising first and second clamps for securing the mesh screen member to the outer surfaces of the first and second bushing members, respectively.

9. The prepacked screen assembly according to claim 8, wherein the outer surfaces of said first and second bushings are each formed with a reduced diameter area for accommodating said first and second clamps.

10. The prepacked screen assembly according to claim 7, wherein said raised lip of each bushing comprises a plurality of lip segments defined by a plurality of gaps or slots formed between the lip segments, whereby said lip segments allow the raised lips to flex outward during assembly.

11. The prepacked screen assembly according to claim 7, wherein said raised lips are formed on inner surfaces of a plurality of axially extending segments that extend in a cantilever fashion along the inner bores of said first and second bushings.

* * * * *